US005331788A

United States Patent [19]

Cinotti

[11] Patent Number: 5,331,788

[45] Date of Patent: Jul. 26, 1994

[54] DEVICE FOR INDUCING SLACK IN A WRAPPING FILM, ASSOCIATED WITH MEANS FOR CONVEYING PACKS OF ROLLS

[75] Inventor: Andrea Cinotti, Bologna, Italy

[73] Assignee: Wrapmatic, S.p.A., Bologna, Italy

[21] Appl. No.: 961,090

[22] Filed: Oct. 14, 1992

[30] Foreign Application Priority Data

Oct. 31, 1991 [IT] Italy ..... BO91A000410

[51] Int. Cl.[5] ..... B65B 11/06

[52] U.S. Cl. ..... 53/228; 53/231; 53/232; 53/526; 53/528

[58] Field of Search ..... 53/228, 231, 232, 233, 53/526, 528, 466, 586

[56] References Cited

U.S. PATENT DOCUMENTS

| | | | |
|---|---|---|---|
| 3,338,026 | 8/1967 | Billi | 53/233 |
| 3,631,649 | 1/1972 | Close et al. | 53/415 |
| 3,705,476 | 12/1972 | Wolf . | |
| 4,341,056 | 7/1982 | Leanna et al. | 53/586 X |
| 4,624,096 | 11/1986 | Nordstrom | 53/228 X |
| 4,679,379 | 7/1987 | Cassoli | 53/540 X |
| 4,854,108 | 8/1989 | Cassoli | 53/232 X |
| 5,038,549 | 8/1991 | Nordstrom | 53/541 X |

*Primary Examiner*—John Sipos
*Assistant Examiner*—Daniel Moon
*Attorney, Agent, or Firm*—Laff, Whitesel, Conte & Saret

[57] ABSTRACT

In a machine for packaging rolls of household paper products, packs are restrained between groups of vertical teeth associated with a conveyor passing through a wrapping station, a folding station and a heat seal station; equipping the wrapping station with additional vertical teeth fixed to a support afforded by the machine which are positioned alongside and offset from the group of conveyor teeth remote from the folding station, at a distance from the remaining group of conveyor teeth less than the distance which separates the two groups of conveyor teeth, a tighter restraint can be applied as the rolls are enveloped initially in the relative sheet of wrapping film, whereupon the movement of the conveyor teeth beyond the station will allow the sheet to slacken, and the rolls to regain their normal shape.

4 Claims, 1 Drawing Sheet

FIG1
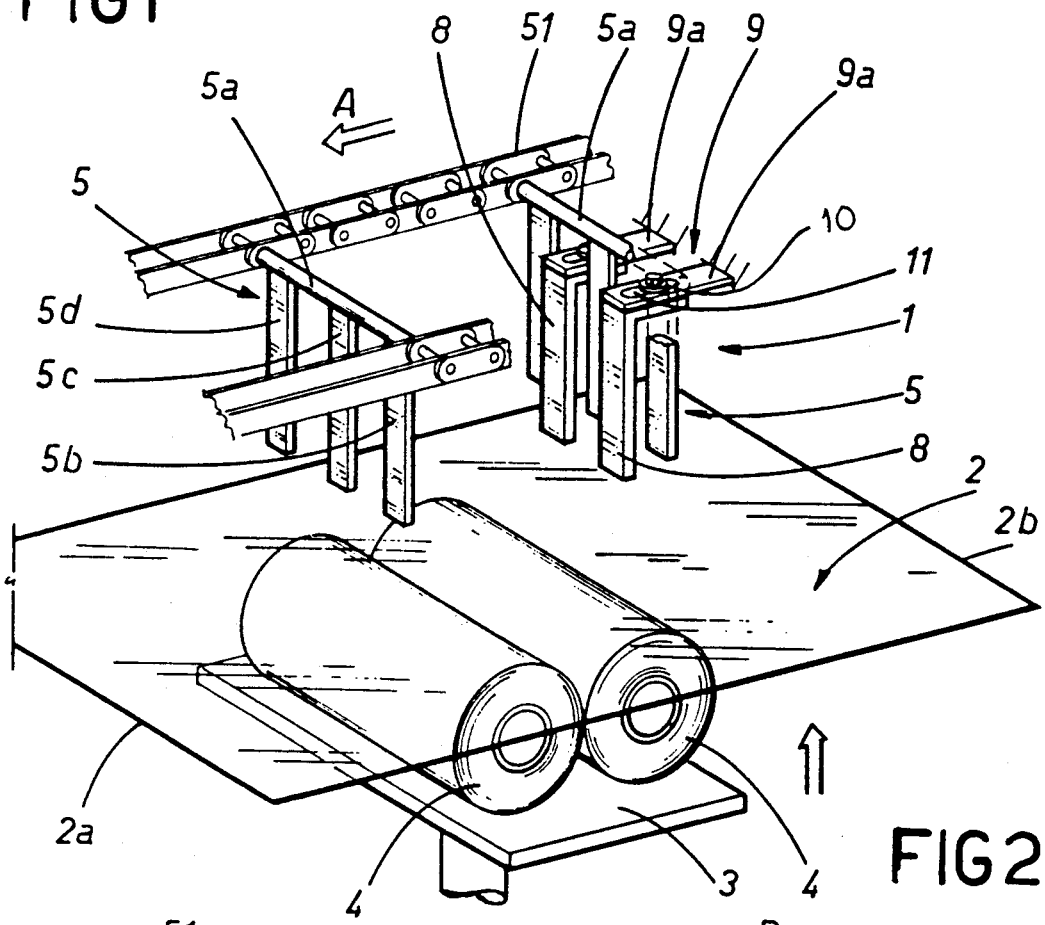
FIG2
FIG3
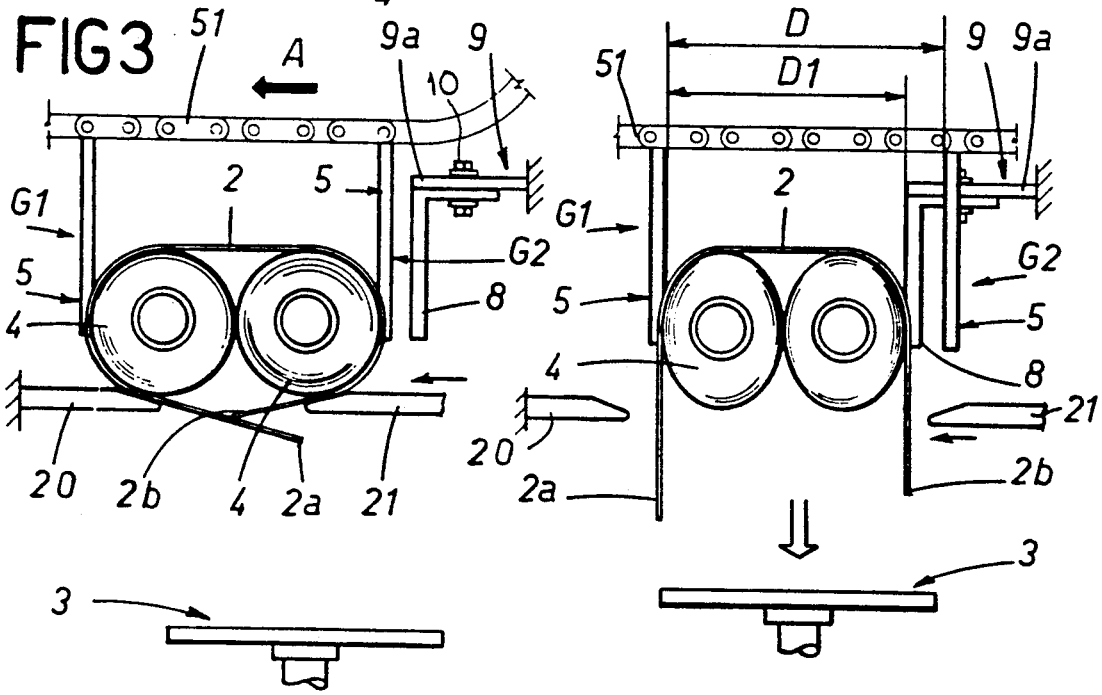

DEVICE FOR INDUCING SLACK IN A WRAPPING FILM, ASSOCIATED WITH MEANS FOR CONVEYING PACKS OF ROLLS

BACKGROUND OF THE INVENTION

The present invention relates to a device for inducing slack in a wrapping film, associated with the conveyors by which packs of rolls are directed through a non-continuous packaging machine. In a packaging machine of the type in question, traditional packs of two or four rolls are wrapped in a covering of transparent plastic film using a process that involves passage through a succession of stations comprising an elevator by which the rolls are received in pairs, in contact one with another and horizontally disposed, and carried upward in this same configuration to the point of entering a first wrapping station beneath which a sheet of film is extended flat in readiness to be fashioned into a wrapping around the pack.

The ascending rolls are first partially enveloped from above, as a result both of investing the sheet and of the reaction afforded by a pair of vertical restraints between which the rolls remain lodged when the elevator returns to the lowered position for a successive cycle. The stations next in line are equipped with understroking horizontal folding or flattening devices, from which the pack emerges with the sheet of wrapping film passed fully around the rolls and the two flattened edges overlapping. The vertical restraints are embodied as projecting elements rigidly associated with a pair of looped chains forming a continuous conveyor, the distance between the centres of the restraints establishing the space afforded to the rolls, and the indexing step of the chains determining the distance covered by the packs when transferred from one wrapping station to the next.

The wrapping operations having been effected, all along a predetermined feed axis, the pack of rolls is positioned at a heat seal station where the overlapping edges of the sheet of film are secured; the station in question consists substantially in a roller occupying a position below the feed axis and of axial dimensions corresponding to those of the sheet of film, rotatable about its own axis in a direction concurrent to that followed by the pack and furnished with a heated sector (heat generated from an external source by Joule effect) by which the temperature of the overlapping edges of the sheet of film is raised to the point of softening and thus enabling a heat seal, preferably at points clearly defined by a serrated profile formed on the sector. In successive steps, the end folds of the wrapping are flattened and secured in conventional manner.

The main drawback betrayed by a pack emerging from the stations in question is that of the excessive peripheral tension in the wrapping. In the process of being enveloped by the plastic film, in effect, the paired rolls are pulled together and forced out of shape over the areas breasted in mutual contact; such deformation is caused mainly by the excessive pressure exerted by the horizontal folding devices, in combination with the pressure exerted from each side by the conveyor restraints (necessary in order to support the pack during its passage through the various wrapping steps), and results in a finished package of substandard appearance.

Accordingly, the object of the present invention is to overcome the drawback in question by providing a device for inducing slack in a wrapping sheet that is simple, efficient and precise in operation, and constructed in a way such as to interfere neither with the structure of conventional work stations nor with the assembly, wrapping and heat seal tempos typical of existing automatic machines.

SUMMARY OF THE INVENTION

The stated object is duly realized in a device for inducing slack in a wrapping film as used for paper rolls packaged by a machine comprising a conveyor designed to pass through a first wrapping station, equipped with a vertical elevator by which the pack of rolls is directed upward into contact with a sheet of wrapping film disposed tranversely between the elevator and at least one pair of vertical teeth supported from above by the conveyor; these teeth are disposed parallel one with another and separated by a distance such that the rolls are restrained and supported from each side together with the sheet of wrapping film and carried along a feed direction coinciding with the packaging line of the machine, which passes through at least two further stations positioned following the wrapping station along the feed direction, at which two edges of the sheet of film are folded flat against the bottom face of the pack in overlapping contact and heat sealed.

The device consists essentially in an additional fixed vertical tooth secured to a support afforded by the machine, positioned adjacent to and offset from the vertical tooth of the conveyor means lying remote from the folding station and disposed facing the conveyor tooth nearer to the folding station, from which it is separated by a distance less than the distance which separates the two conveyor teeth themselves; accordingly, the ascending rolls are restrained at first with the partly enveloping sheet of wrapping film drawn taut, whereupon the movement of the conveyor teeth away from the fixed tooth allows a slackening of the film.

BRIEF DESCRIPTION OF THE DRAWINGS

The invention will now be described in detail, by way of example, with the aid of the accompanying drawings, in which:

FIG. 1 illustrates part of a machine for wrapping packs of rolls incorporating the device according to the present invention, viewed in perspective from the front with certain parts omitted better to reveal others;

FIG. 2 illustrates the part of the machine shown in FIG. 1, viewed in side elevation with certain parts omitted better to reveal others and in a different operating configuration;

FIG. 3 illustrates the part of the machine shown in FIG. 1, viewed in side elevation with certain parts omitted better to reveal others and in a further operating configuration.

DESCRIPTION OF THE PREFERRED EMBODIMENTS

Referring to the accompanying drawings, the device according to the invention for inducing slack in a wrapping film is associated with the conveyor of a machine for packaging rolls, typically of household paper products; such a machine (shown in FIG. 1) comprises a first wrapping station 1, one part of which consists in an elevator 3 capable of movement through a vertical direction, by which a pack of rolls 4 is directed upward and into contact with a sheet 2 of the wrapping film disposed transversely between the elevator and a pair of vertical teeth 5 by which the rolls 4 are restrained on either side. The teeth 5 are disposed parallel one with another, separated by a distance denoted D, and suspended rigidly from moving conveyor means 5*a* consisting in a pair of horizontal and parallel chains 51 in such a way as to allow of carrying the rolls 4 along a feed direction A, coinciding effectively with the packaging line of the machine, through two further stations (not illustrated, being conventional in embodiment and outside the scope of the invention) at which, respectively, the unsecured edges 2*a* and 2*b* of the wrapping sheet 2 are folded flat against the bottom of the pack in overlapping contact and heat sealed.

In practice, the vertical teeth 5 consist in two groups, referred to as G1 and G2 for the sake of simplicity, each comprising three single teeth 5*b*, 5*c* and 5*d* disposed alongside and equidistant one from another and directly opposite the three teeth of the remaining group. These are supplemented, moreover, at a given point in alignment with the elevator 3 and adjacent to the group G2 of teeth farther from the folding station, in relation to the feed direction A, by two additional vertical teeth 8 of fixed embodiment secured to a support 9 afforded by the machine.

The teeth 8 in question occupy a position offset from the those of the adjacent group G2, resulting in a staggered formation, and separated from the teeth of the remaining group G1 by a distance D1 less than the distance D that separates the teeth of the two groups G1 and G2 themselves, in such a way that the ascending rolls 4 are restrained at first with the sheet 2 of wrapping film drawn taut, whereupon translatory movement of the two groups G1 and G2 will allow a partial release of the film covering the rolls.

More exactly, each of the two additional vertical teeth 8 consists in a bar of upturned "L" profile fastened to a relative horizontal rail 9*a* extending the entire length of the station 1; each tooth 8 is secured to the rail 9*a* by means of screw means 10 slidably retained in a respective slot 11 formed in the support 9, and thus adjustable for position. A packaging machine equipped with the additional teeth functions in the following manner: rolls 4 carried upward by the elevator 3 are enveloped in part initially by the sheet 2 of film, positioned previously below the groups G1 and G2 of conveyor teeth 5 and the two additional teeth 8, whereupon the rolls are directed together with the sheet into the space compassed by the offset teeth 8 and the group of teeth G1 opposite which, to reiterate, are separated by a distance D1 less than the distance D between the two groups G1 and G2 of conveyor teeth. Thus, the pack of rolls 4 is discernibly compacted when wrapped initially (see FIG. 2) in the sheet 2 of film.

As the two groups G1 and G2 of conveyor teeth are moved forward by the chains 51, carrying the pack of rolls 4 between them, the increased clearance (greater than that afforded initially) allows the rolls to expand as the pack progresses and the two edges 2*a* and 2*b* of the sheet 2 are flattened (see FIG. 3) through the action of folders 20 and 21, by which the rolls are also supported from beneath; the result is that the assembled pack presents a neater appearance with the overlapping edges of the wrapping sheet more precisely arranged. Thereafter, the pack continues forward to the heat seal station in a fully re-expanded configuration, ready for the formation of a permanent join along the overlapping edges 2*a* and 2*b*.

What is claimed:

1. A device for enveloping packs of rolls assembled and packaged by a non-continuous machine, comprising:

an overhead conveyor means;

a first wrapping station, equipped with a vertical elevator by which a pack of rolls is directed upward into contact with a sheet of wrapping film disposed transversely between the elevator and a pair of vertical teeth supported from above by the overhead conveyor means, said vertical teeth disposed parallel to each other and separated by a set distance along a horizontal feed direction, between which the rolls are restrained and supported by pressure on each side together with the sheet of wrapping film and carried along the horizontal feed direction;

at least one additional vertical tooth of fixed embodiment secured to a support afforded by the machine, at said first wrapping station, said first vertical tooth positioned adjacent and offset from a vertical tooth of the conveyor means lying farther from a downstream folding station in relation to the feed direction and separated from a conveyor tooth nearer to the downstream folding station by a distance less than the distance which separates the two conveyor teeth, such that the ascending rolls are restrained at first between the shorter distance located between the movable conveyor tooth closest to the folding station and the fixed vertical tooth so that the partly enveloping sheet of wrapping film is initially drawn taut, whereupon a translatory movement of the conveyor teeth in the feed direction allows for a wider distance in which the rolls are positioned between the two conveyor teeth and creates a partial release of the enveloping film thereby extending the amount of film allowed to lay across the peripheral length of the rolls, prior to folding and heat sealing overlapping edges of said wrapping film.

2. A device as in claim 1, wherein the additional fixed vertical tooth consists in at least one bar having a reversed "L" profile fixed to a horizontal rail extending at least to a position directly above the elevator.

3. A device as in claim 2, wherein each of said pair of vertical teeth comprises three individually spaced teeth, said at least one additional vertical tooth comprises at least two additional vertical teeth, and said additional vertical teeth being in a staggered formation with regard to adjacent individually spaced teeth.

4. A device as in claim 2, wherein the at least one additional tooth is fixed to the support by way of screw means slidably retained in a respective slot afforded by the support, and thus adjustable for position.

* * * * *